US007419405B1

(12) United States Patent
Landes et al.

(10) Patent No.: US 7,419,405 B1
(45) Date of Patent: Sep. 2, 2008

(54) DEHUMIDIFIER SAFETY CUT-OFF SYSTEM

(76) Inventors: Rock Landes, 5845 P.W.A. Dr., Cumming, GA (US) 30041; Sam Landes, 5845 P.W.A. Dr., Cumming, GA (US) 30041

( * ) Notice: Subject to any disclaimer, the term of this patent is extended or adjusted under 35 U.S.C. 154(b) by 0 days.

(21) Appl. No.: 11/900,456

(22) Filed: Sep. 12, 2007

(51) Int. Cl.
*H01R 13/66* (2006.01)

(52) U.S. Cl. ..... 439/620.08; 200/61.04

(58) Field of Classification Search ..... 439/620.08, 439/502; 200/61.04, 61.06; 174/66, 67
See application file for complete search history.

(56) References Cited

U.S. PATENT DOCUMENTS 4,418,712 A * 12/1983 Braley ..... 137/312
4,780,094 A * 10/1988 Batty et al. ..... 439/492
D310,412 S 9/1990 Fukumoto et al.
5,071,370 A * 12/1991 Kochan, Jr. ..... 439/620.21
5,074,119 A 12/1991 Anderson
5,424,903 A * 6/1995 Schreiber ..... 361/166
5,555,732 A 9/1996 Whiticar
5,884,495 A 3/1999 Powell et al.
6,182,453 B1 2/2001 Forsberg
6,468,095 B2 * 10/2002 Kerr et al. ..... 439/140
6,505,477 B1 1/2003 Smith et al.
6,694,093 B2 * 2/2004 Morris et al. ..... 392/479
7,284,996 B2 * 10/2007 Kidman ..... 439/136

OTHER PUBLICATIONS

SYLVANE.COM, Sana Fe Rx Dehumidifier, Mar. 1, 2007, http://www.sylvane.com/santa-fe-rx-dehumidifer.html.

* cited by examiner

*Primary Examiner*—Thanh-Tam T Le

(57) ABSTRACT

The present invention relates to a dehumidifier safety cut-off system. This invention is an after-market safety accessory for existing dehumidifiers which operate through the use of a condensate-pump. The safety cut-off system would automatically shut down a dehumidifier in the event of pump failure by disabling the power supply to the dehumidifier. This system would consist of a compact housing with an external power cord, a transformer, a normally closed relay, and a pair of external, low voltage leads that would be connected to the safety float switch leads of the condensate pump. The invention could also feature an alternative version that could be hard wired in place.

1 Claim, 3 Drawing Sheets

DEHUMIDIFIER SAFETY CUT-OFF SYSTEM

CROSS REFERENCE TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to a dehumidifier safety cut-off system. This invention is a safety accessory for dehumidifiers which operate through the use of a condensate-pump.

B. Discussion of the Prior Art

The Powell et al. patent (U.S. Pat. No. 5,884,495) discloses a dehumidifier comprising of an adjustable float with a variable height cam surface that is in contact with the actuator on an interlock switch, which controls the supply of power to the refrigeration system of the dehumidifier. While the Powell patent has features that provide an adjustable float for setting the moisture level shutoff, it does not provide an alternative shutoff in the event of condenser pump failure. The present invention differs from the dehumidifier of the Powell patent in that the present invention is designed to be a secondary safety switch that will shut the dehumidifier off in the event of pump failure even if the float sensor in the dehumidifier fails.

The Anderson patent (U.S. Pat. No. 5,074,119) discloses a dehumidifier apparatus with a pump assembly to provide for automatic and continuous emptying of water condensate from a dehumidifier that is positioned below ground level. The dehumidifier apparatus of the Anderson patent overcomes the traditional gravitational flow of water problems by using a pump type feature to be able to pump water from the dehumidifier to a higher level. However, the dehumidifier apparatus of the Anderson patent does not feature an additional safety feature that would shut of the condenser in the event of a failure. The present invention differs in that it is designed to be a secondary safety feature for a dehumidifier rather than a primary safety feature being incorporated into the existing dehumidifier.

The Whiticar patent (U.S. Pat. No. 5,555,732) discloses a portable dehumidifier. While the Whiticar patent discloses numerous safety features, the present invention differs because it is designed for being a secondary safety feature that may be added onto a dehumidifier rather than a primary safety feature integrated into an existing dehumidifier.

The Forsberg patent (U.S. Pat. No. 6,182,453) discloses a portable, potable-water generator for producing water by the condensation of dew from highly ambient air. While the Forsberg patent has numerous subsystems that will disable the generator, the potable-water generator of the Forsberg patent does not provide a secondary safety device. Furthermore, the secondary safety device of the present invention is designed to stop the flow of water from a dehumidifier, rather than a system that is designed to provide potable drinking water.

The Smith et al. patent (U.S. Pat. No. 6,505,477) discloses an apparatus to extract water from ambient air. The apparatus includes a dehumidifier, a holding tank, and one or more dispensing tanks. The Smith patent differs from the present invention in that the dehumidifier of the Smith patent does not provide a secondary safety device. Furthermore, the secondary safety device of the present invention is designed to stop the flow of water from a dehumidifier, rather than a system that is designed to provide potable drinking water.

The Fukumoto patent et al. (U.S. Pat. No. Des. 310,412) discloses an ornamental design for a dehumidifier, which fails to illustrate any type of safety measures for preventing water spillage in the event of a malfunction.

The Santa Fe Rx Dehumidifier by Sylvane, a non-patent prior art document, involves a dehumidifier with a built-in safety shutoff switch, which is analogous to the type of shut-off switches disclosed above in the prior art documents. However, the dehumidifier is designed to include a shutoff switch, and not directed to an after-market accessory purchased for the specific purpose of acting as a second safety shut-off switch.

BRIEF SUMMARY OF THE INVENTION

The present invention relates to a dehumidifier safety cut-off system. This invention is an after-market safety accessory for existing dehumidifiers which operate through the use of a condensate-pump. The safety cut-off system would automatically shut down a dehumidifier in the event of pump failure by disabling the power supply to the dehumidifier. This system would consist of a compact housing with an external power cord, a transformer, a normally closed relay, and a pair of external, low voltage leads that would be connected to the safety float switch leads of the condensate pump. The invention could also feature an alternative version that could be hard wired in place.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
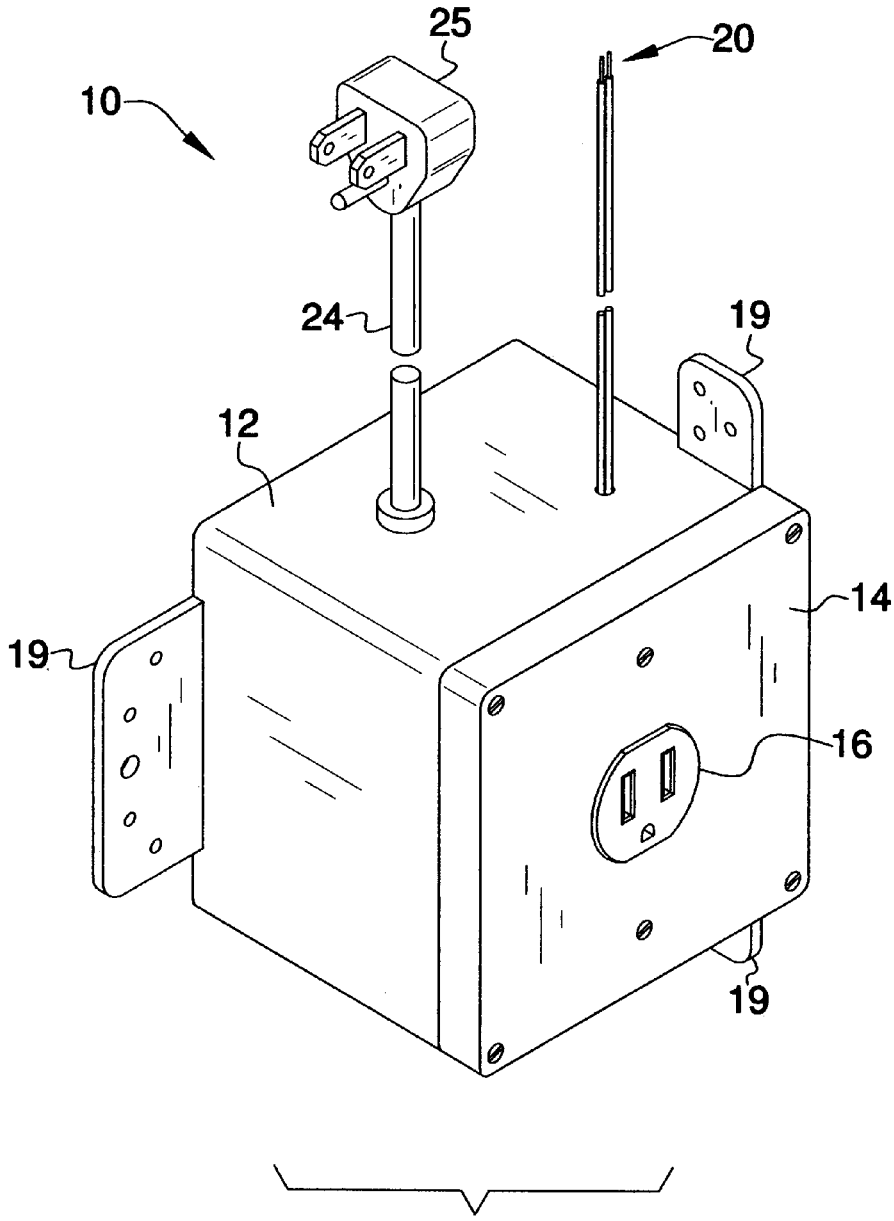
FIG. 1 illustrates an isometric view of the invention.

Detailed reference will now be made to the present invention, examples of which are illustrated in FIGS. 1-5. a dehumidifier safety cut-off system 10 (hereinafter invention) which includes a receptacle connection box 12, that has a box cover 14 with a receptacle outlet 16 to supply power to a dehumidifier 23. The receptacle connection box 12 also has a pair of mounting plates 19 and a pair of low voltage wires 20 that attach to a safety float switch of a condensate pump 22. The receptacle connection box 12 is powered by a power cord 24, which contains a plug 25 at the end of the power cord 24.

Figure 2:
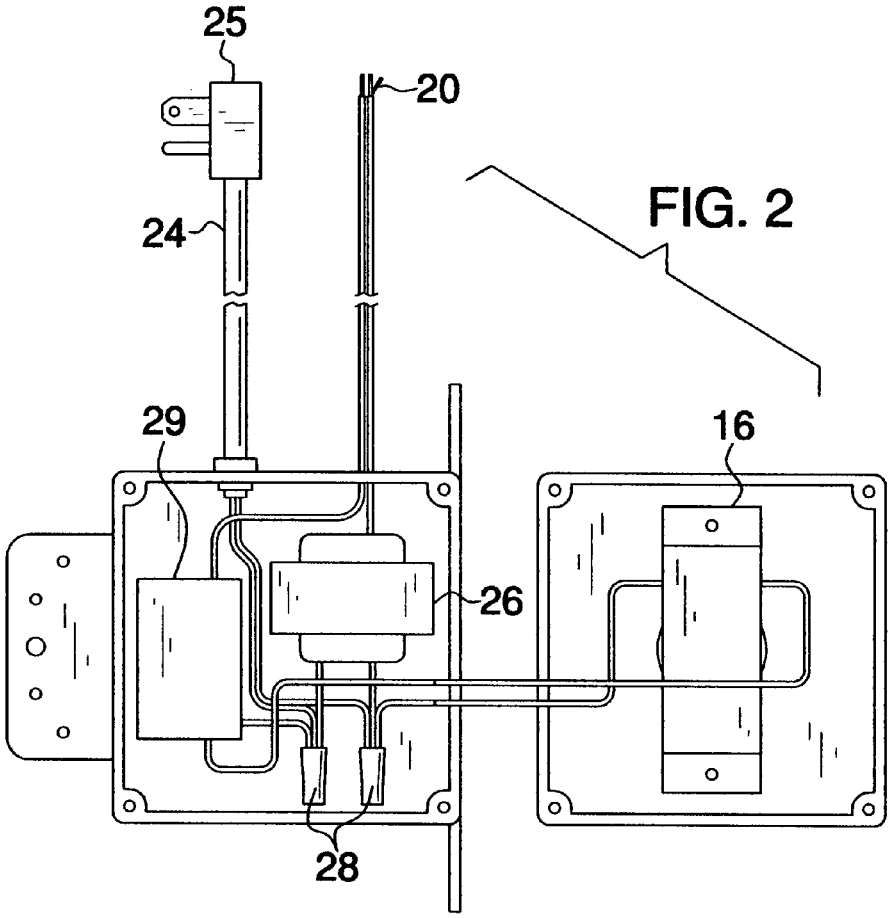
FIG. 2 illustrates an exploded view of the invention

Referring to FIG. 2, a transformer 26 is wired by a pair of crimp caps 28 to a relay 29, the power cord 24, and the receptacle 16. The left low voltage wire 20 is wired to the relay 29 and the right low voltage wire 20 is wired to the transformer 26.

The power cord 24 powers the transformer 26, which in turn powers the low voltage wiring 20 at a reduced wattage or voltage. The low voltage wiring 20 attaches to the safety float switch of the condensate pump 22. The dehumidifier safety switch relay 29 controls the power supply to the receptacle outlet 16.

Figure 3:
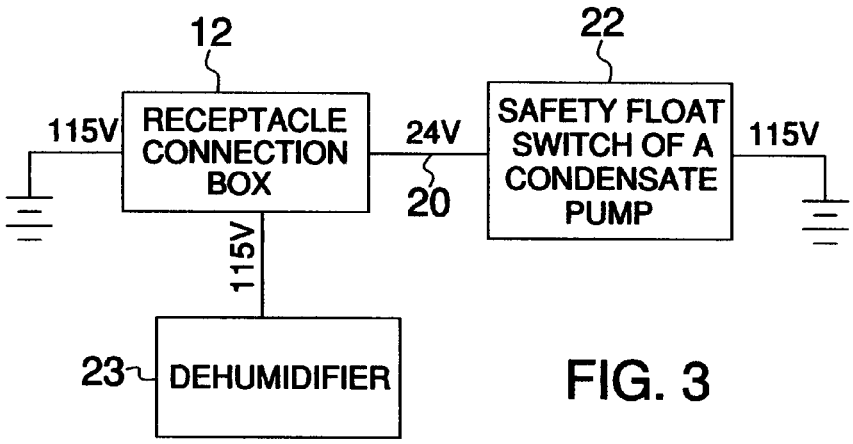
FIG. 3 illustrates a wiring diagram of the invention connected to the exterior components.

Referring to FIG. 3 the receptacle connection box 12 is shown providing electricity to the dehumidifier 23 at 115 volts, which is accomplished by plugging in the dehumidifier 23 into the receptacle 16. In FIG. 3 the receptacle connection box 12 is connected to the safety float switch of the condensate pump 22, which is accomplished by connecting the low voltage wires to the existing safety float switch of the condensate pump 22.

It shall be noted that for existing condensate pumps that do not include a safety float switch, a safety float switch will be required for the invention 10 to operate, and for such situations will be included for such purposes.

Figure 4:
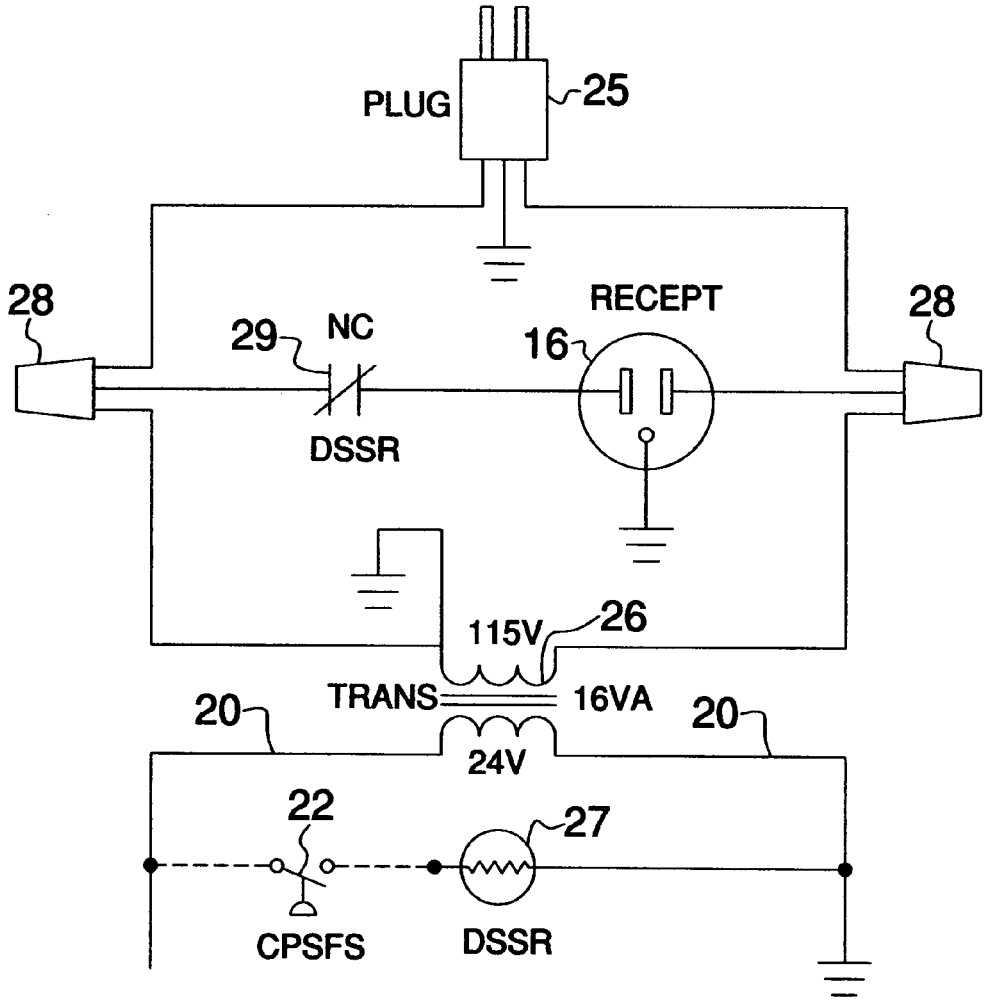
FIG. 4 illustrates a wiring diagram of the electrical components of the invention.

Referring to FIG. 4, the power cord 24 provides power to the transformer 26 which provides 24 volt current to the low voltage wiring 20 which attaches to the condensate pump safety float switch 22 which controls the dehumidifer safety switch relay 29 that powers the receptacle outlet 16.

It shall be noted that the primary benefit of the invention 10 is to provide an alternative safety mechanism to an existing dehumidifier in which electricity supplied to the dehumidifier by an electrical receptacle will shut off.

While the embodiments of the invention have been disclosed, certain modifications may be made by those skilled in the art to modify the invention without departing from the spirit of the invention.

The inventors claim:

1. A dehumidifier safety cutoff system comprising;

(a) a connection box;

wherein the connection box contains a plurality of mounting plates or brackets in order to mount the connection box to a secure location;

(b) a connection box cover;

wherein the connection box cover is designed to screw onto the front of the connection box in order to seal off access to the internal componentry contained within the connection box;

(c) a receptacle;

wherein the receptacle is mounted to the connection box cover;

wherein the receptacle is provided to enable a dehumidifier to be plugged into the receptacle;

(d) a transformer;

wherein the transformer has a high voltage input side and low voltage output side;

wherein the high voltage input side will transform the electricity passing through the coil to a low voltage output side of the coil;

(e) a relay;

(f) a set of low voltage wires;

(g) a power cord;

wherein a plug is located at one end of the power cord and the plug is capable of being plugged into a standard wall outlet;

(h) a pair of crimper caps;

wherein the high output side of the transformer has a positive line coming in and a negative line going out and is electrically wired by a pair of crimper caps on the negative positive leads, respectively, to the power cord, the relay, and the receptacle;

wherein the positive lead of the low voltage line is energized through the low output side of the transformer;

wherein the opposite end of the positive lead of the low voltage line is connected to a positive lead of a safety float switch located in a condensate pump;

wherein the negative lead of the low voltage line is connected at an input end of the relay;

wherein the opposite end of the negative lead of the low voltage line is connected to the negative lead of the safety float switch located in the condensate pump; and whereupon the safety float switch making the circuit between the low voltage positive and negative wires, the relay will make and shut off the positive line to the receptacle thereby stopping the passage of electrical current to the receptacle and thus to the dehumidifier.

* * * * *